US008740194B1

(12) United States Patent
Alenzi

(10) Patent No.: US 8,740,194 B1
(45) Date of Patent: Jun. 3, 2014

(54) BUOYANT AERATOR ARRAY WITH REMOTE AIR SUPPLY

(71) Applicant: Bader Shafaqa Alenzi, Abdulla Almubarak (KW)

(72) Inventor: Bader Shafaqa Alenzi, Abdulla Almubarak (KW)

( * ) Notice: Subject to any disclaimer, the term of this patent is extended or adjusted under 35 U.S.C. 154(b) by 0 days.

(21) Appl. No.: 14/078,229

(22) Filed: Nov. 12, 2013

(51) Int. Cl.
*B01F 3/04* (2006.01)

(52) U.S. Cl.
USPC ..... 261/77; 162/120; 162/121.1

(58) Field of Classification Search
CPC .... B01F 3/04; B01F 3/04099; B01F 3/04106; B01F 3/04241
USPC ..... 261/77, 120, 121.1; 210/220
See application file for complete search history.

(56) References Cited

U.S. PATENT DOCUMENTS 3,320,928 A 5/1967 Smith
3,671,022 A 6/1972 Laird et al.
4,070,423 A * 1/1978 Pierce ..... 261/77
4,152,259 A 5/1979 Molvar
5,906,774 A * 5/1999 Loy ..... 261/120
6,264,176 B1 7/2001 Dickman et al.
7,448,600 B1 11/2008 Boulter
2007/0039878 A1 2/2007 Roberts et al.
2012/0228216 A1 9/2012 Gavrieli et al.

* cited by examiner

*Primary Examiner* — Robert A Hopkins
(74) *Attorney, Agent, or Firm* — Richard C. Litman

(57) ABSTRACT

The buoyant aerator array with remote air supply has a plurality of aerators disposed in a body of water and supplied with air from a single remote source. The remote source may be land-based or based upon a floating vessel. An air supply line extends from the remote air source to each aerator. Each line is supported by one or more rigid poles or columns anchored into the floor of the body of water. Two aerator embodiments are described herein, with each having a toroidal float. In one embodiment, the entire aerator structure floats to hold the aerator at a constant level, and is held in position by restraining cables. Another embodiment has a plurality legs anchored to the bottom, the float and attached aerator riding along the legs to maintain a constant aerator level below the surface as the water level changes.

13 Claims, 4 Drawing Sheets

BUOYANT AERATOR ARRAY WITH REMOTE AIR SUPPLY

BACKGROUND OF THE INVENTION

1. Field of the Invention

The present invention relates generally to liquid aeration systems, and more particularly to a buoyant aerator array with remote air supply that is located on-shore or aboard a ship or other floating vessel.

2. Description of the Related Art

The contamination of various bodies of water by various means is an increasingly serious problem worldwide. The most widespread contaminants may be organic materials that enter the water system due to pollution from human habitation, either directly or indirectly, e.g., pollution from farms and the like. Such pollution can affect inland fresh water supplies (lakes and rivers), and can also be carried to the sea by inland rivers and waterways or by direct discharge of sewage and/or other pollutants into the sea. Organic material in the sewage of treatment plants is another example of such pollution, although contained for processing. The biochemical processes that occur in water due to such organic pollution are known to decrease the oxygen content of the water, thereby reducing or perhaps even destroying fish and other aquatic life in the contaminated body of water. Even if some fish remain in the polluted water, they are almost certainly unfit for human consumption, if caught.

It is generally considered that the most effective means of eliminating such pollutants in contaminated water is by bacteriological processing, wherein bacteria process the contaminants to break them down into harmless organic materials. However, such bacteria are aerobic, i.e., they require oxygen for their metabolism. This is well known in the sewage treatment field, where water is commonly treated by aeration after solids are removed by settling or other means. Such aeration is generally accomplished by mechanical means, e.g., pumping the water up for dispensing into the air from spray booms and nozzles, or by forcing air through underwater pipes for the air to bubble up through the water. Such mechanical systems are relatively costly to operate and require relatively high energy and manpower costs. Even if such systems were less costly to operate, a huge drawback is that they cannot be readily transported to a pollution site for operation at that site. Rather, the water must be transported to the location of the aeration system, a process that is clearly unworkable on a very large scale and/or over very long distances.

Thus, a buoyant aerator array with remote air supply solving the aforementioned problems is desired.

SUMMARY OF THE INVENTION

The buoyant aerator array with remote air supply comprises a number of different embodiments, each comprising a plurality of buoyant aerators for aerating a body of water. Since the aerators are buoyant, the aeration nozzles are deployed at a constant, uniform depth below the surface of the water at all times, regardless of the water level. All of the aerators receive their air supply from a remotely disposed air source. The air source may be based on shore, or may be based upon a ship or other floating vessel. A flexible air supply line or hose extends from the air supply to each of the buoyant aerators. The hose is supported by one or more rigid columns or poles anchored into the bottom of the body of water in which the aerators are placed.

Two different aerator configurations are described herein. The first has a toroidal float and a plurality of legs extending down from the periphery of the float. A radial array of aeration tubes or nozzles is affixed between the legs and below the float. Since the float remains atop the water, the aeration tubes remain at a constant depth below the surface. Thus, the air supply remains at a constant pressure with no need for variance. The second aerator configuration also has a toroidal float, but the float is captured between a plurality of parallel legs that are anchored to the bottom or floor of the body of water. The float is free to slide up and down on these legs according to the water level. The radial array of aeration nozzles is immovably affixed to the float, and remains at a constant depth below the surface of the water as the float rides atop the surface.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The buoyant aerator array with remote air supply comprises various buoyant aerator embodiments that receive air from either a land-based or floating vessel-based source. The buoyant aerators are secured in the body of water in which they are installed, one embodiment being free floating but restrained by cables, and another embodiment being anchored to a fixed base set in the floor of the body of water.

Figure 1:
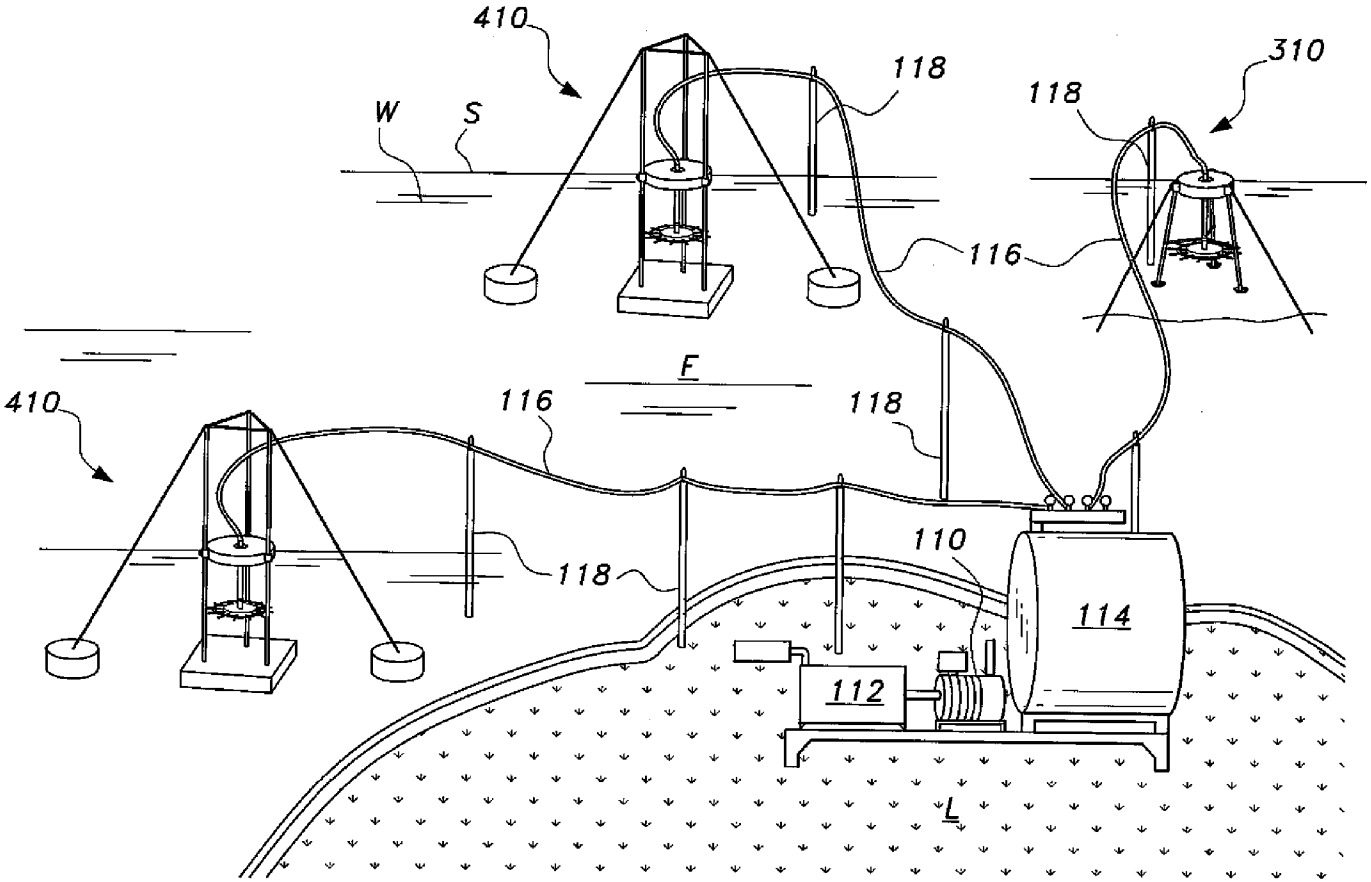
FIG. 1 is an environmental, perspective view of a system of a buoyant aerator array with remote air supply according to the present invention, the air supply being shore-based, the drawing showing two different types of floats.

FIG. 1 of the drawings is a pictorial illustration of a first embodiment of the buoyant aerator array, showing a plurality of different types or embodiments of buoyant aerators receiving their air supply from a single land-based source. The source of air for the buoyant aerators includes a compressor 110 driven by a suitable power source 112 (e.g., gasoline or diesel engine, electric motor, etc.). The compressor 110 delivers air to an air tank 114 to supply the offshore buoyant aerators. The compressor 110, power source 112, and air tank 114 are all installed and based upon the shore or land mass L, clear of the water W. Air is delivered to the various aerators by a separate flexible air delivery line 116 extending from the air tank 114 to each of the aerators, so that each aerator has its own air delivery line 116. Each of the delivery lines 116 is supported above the surface S of the water W by one or more support columns 118. Each of the support columns 118 is immovably affixed and anchored in the underlying land mass L or the floor F of the body of water W.

Figure 2:
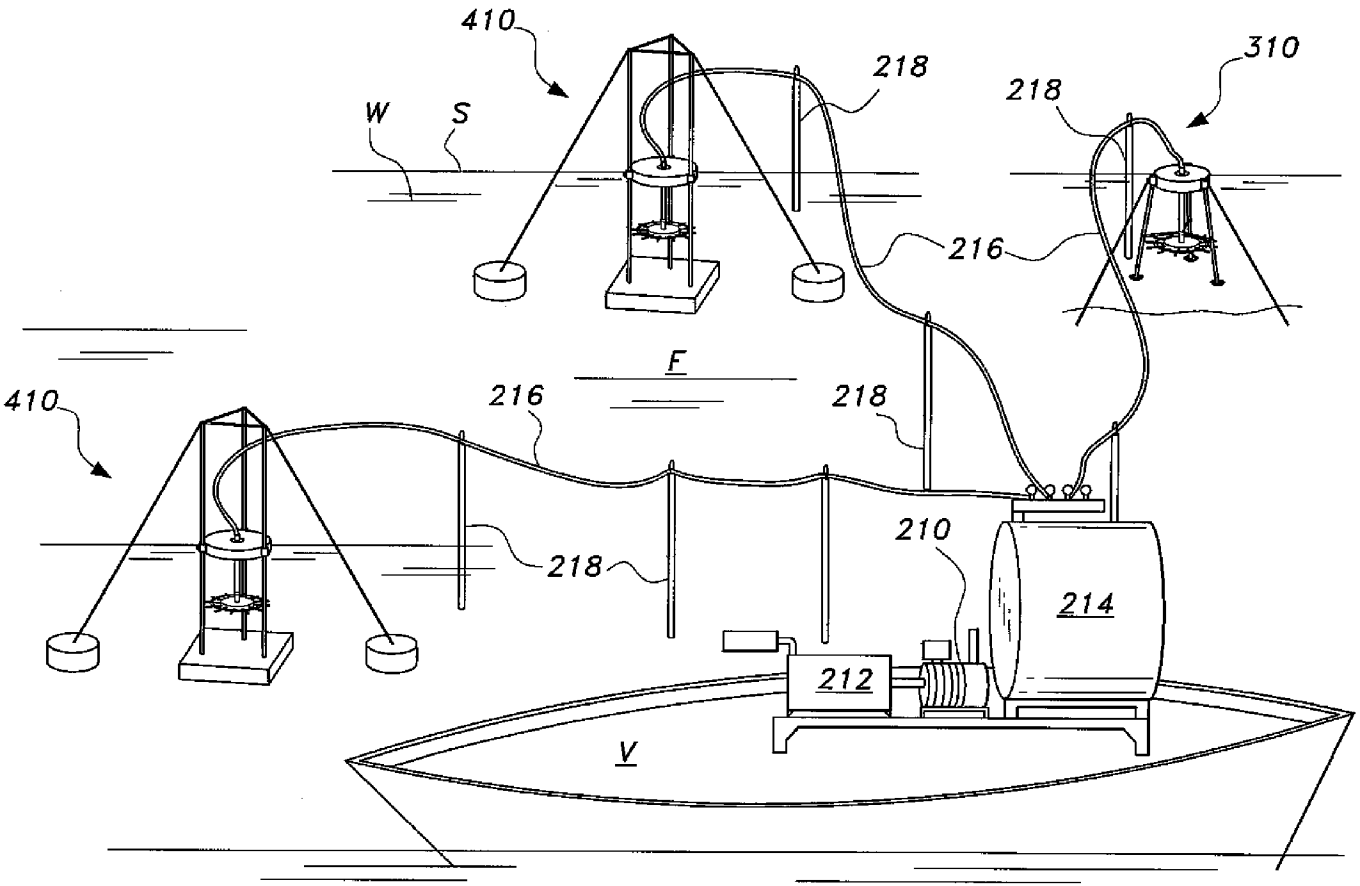
FIG. 2 is an environmental, perspective view of a system of a buoyant aerator array with remote air supply according to the present invention, the air supply being based upon a floating vessel, the drawing showing two different types of floats.

FIG. 2 of the drawings is a pictorial illustration of a second embodiment of the buoyant aerator array, showing a plurality of different types or embodiments of buoyant aerators receiving their air supply from a single floating vessel-based source. The source of air for the buoyant aerators includes a compressor 210 driven by a suitable power source 212 (e.g., gasoline or diesel engine, electric motor, etc.). The compressor 210 delivers air to an air tank 214 to supply the offshore buoyant aerators. The compressor 210, power source 212, and air tank 214 are all installed and based upon the floating vessel V in the water W. Air is delivered to the various aerators by a separate flexible air delivery line 216 extending from the air tank 214 to each of the aerators, so that each aerator has its own air delivery line 216. Each of the delivery lines 216 is supported above the surface S of the water W by one or more support columns 218. Each of the support columns 218 is immovably affixed and anchored in the floor F of the body of water W.

Either of the above embodiments may support an array of buoyant aerators, as shown in FIGS. 1 and 2. While each of those drawings. shows only three aerators, it will be understood that more aerators may be supplied by a single air source, depending upon the amount of air used by each aerator and the capacity of the air supply.

Figure 3:
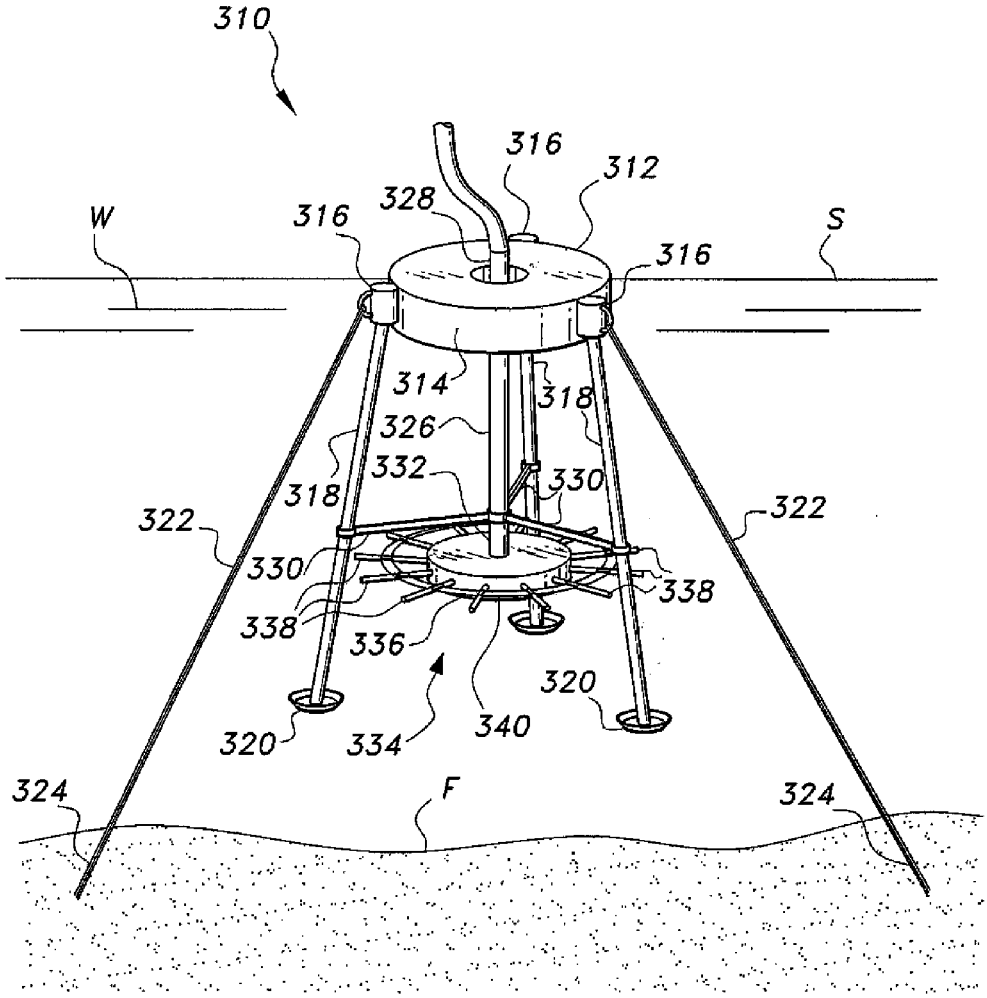
FIG. 3 is a perspective view of a first embodiment of one of the buoyant aerators for a buoyant aerator array with remote air supply according to the present invention.

FIG. 3 of the drawings provides a perspective view of a first embodiment of a buoyant aerator 310. This aerator embodiment comprises a buoyant toroidal float 312 having a periphery 314 and a plurality of leg attachment points or fittings 316 installed thereon. Corresponding rigid support legs 318 extend from the fittings, each leg having a support pad or foot 320 at the base thereof. Corresponding anchor cables or lines 322 extend from the leg attachment points 316. The distal ends 324 of the cables 322 are anchored into the floor F of the body of water W to prevent the aerator 310 from drifting from its installed position. Each of the legs 318 has a fixed length. The support pads 320 remain clear of the floor F of the body of water W when the water depth is greater than the vertical lengths of the legs 318. If the water depth becomes less than the vertical lengths of the legs 318, e.g., due to tidal action, change in level in a reservoir, etc., the support pads 320 rest upon the floor F of the body of water W to support the aerator structure at a predetermined height above the floor F to preclude its contamination with mud or other bottom debris.

The aerator 310 has a single central air delivery column 326 extending substantially vertically through the center hole or passage of the toroidal float 312. The upper end 328 of the column 326 is preferably immovably affixed to the float 312 by suitable braces or the like (not shown) where it passes through the center of the float 312, and by additional similar but longer braces 330 extending from the lower portion or end 332 of the column 326 to each of the support legs 318.

An aeration outlet 334 is immovably affixed to the lower end 332 of the air delivery column 326, and thus to the remaining structure of the aerator 310. The aeration outlet 334 comprises a relatively flat or thin circular central plenum 336 and a plurality of radially disposed and perforated aeration tubes or nozzles 338 extending therefrom. Each of the tubes or nozzles 338 may comprise a single tube, or alternatively, may comprise two concentric tubes, the outer tube extending beyond the outboard end of the inner tube and having a water inlet port(s) at its base. The air exiting the end of the inner tube entrains water flow entering through the water inlet port in the outer tube to diffuse the aeration bubbles flowing from the device. A circular brace 340 is disposed concentrically about the aeration or diffuser tubes 338 and spaced outwardly from the plenum 336, tying the tubes 338 together for greater security. As the aeration outlet 334 is immovably affixed to the remaining structure of the aerator 310, including its float 312, it will be seen that the aeration tubes 338 remain at a constant fixed depth below the float 312. Thus, as the float 312 rides upon the surface of the water (assuming adequate water depth so that the legs 318 are not resting upon the floor F of the body of water W), the aeration tubes 338 also remain at a constant fixed depth below the surface of the water. Since this depth is fixed, the water pressure or head at the depth of the aeration tubes is also fixed, thus requiring a constant air pressure from the air supply of either FIG. 1 or FIG. 2. No adjustment of the air pressure is required for the aerator 310, once the pressure has been set.

Figure 4:
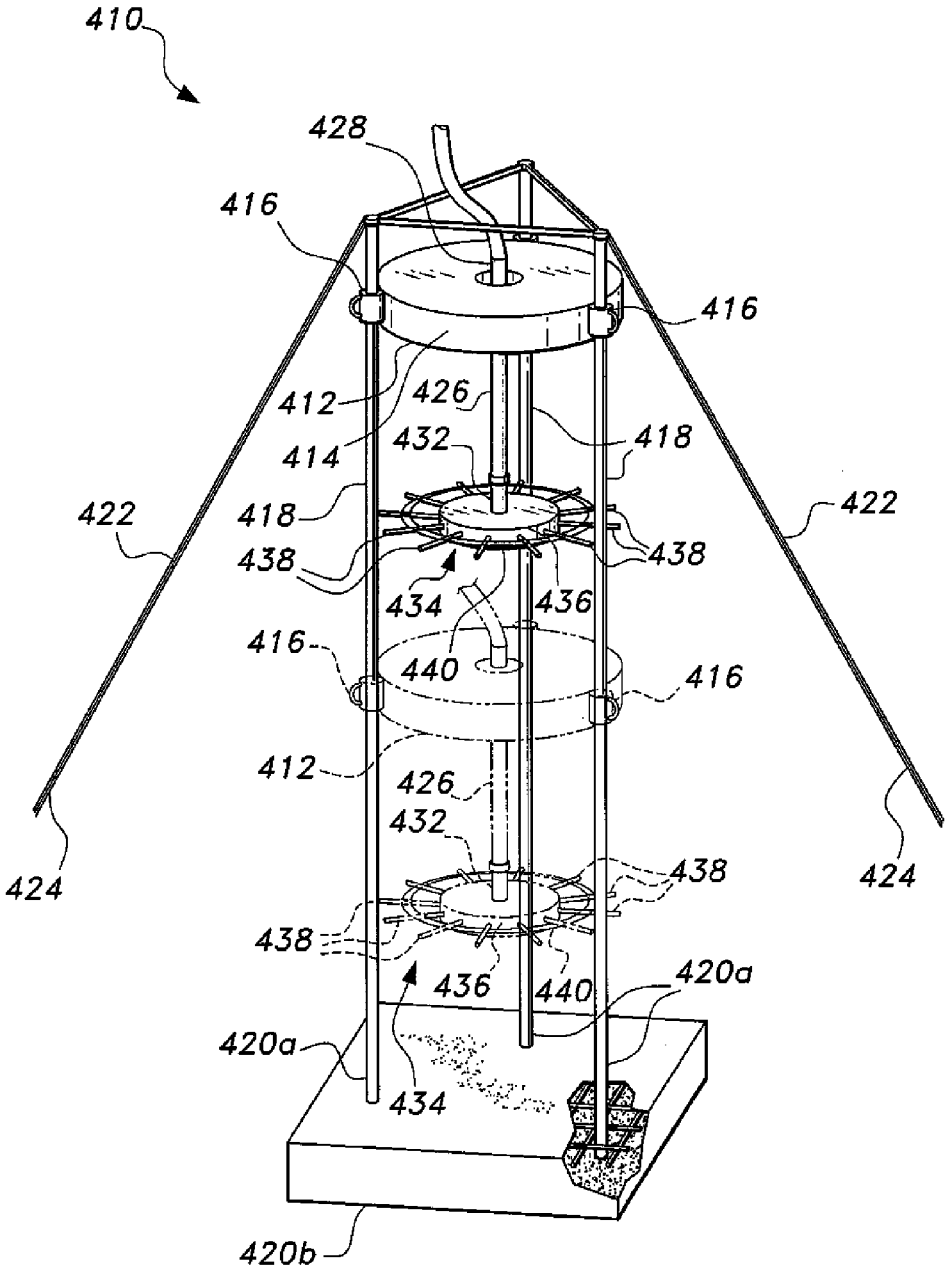
FIG. 4 is a perspective view of a second embodiment of one of the buoyant aerators for a buoyant aerator array with remote air supply according to the present invention.

FIG. 4 of the drawings provides a perspective view of an alternative embodiment of a buoyant aerator, designated as aerator 410. The aerator 410 includes many components that correspond to those like components of the buoyant aerator 310 illustrated in FIG. 3 and described above. The aerator 410 has a buoyant toroidal float 412 having a periphery 414 and a plurality of leg attachment passages 416 installed thereon. Corresponding parallel rigid vertical guides 418 have lower ends 420*a* anchored or immovably affixed in a heavy base 420*b* of concrete or the like. Each base 420*b* of the aerator 410 rests immovably upon the floor F of the body of water W, as shown in FIGS. 1 and 2. This structure allows the float 412 to move vertically between the guides 418 as the water level changes, the leg attachment passages 416 sliding vertically along the guides 418. Corresponding anchor cables or lines 422 extend from the leg attachment passages 416. The distal ends 424 of the cables 422 are anchored into the floor F of the body of water W (shown in FIGS. 1 and 2) to provide further security for the aerator 410.

The aerator 410 has a single central air delivery column 426 extending substantially vertically through the center hole or passage of the toroidal float 412. The upper end 428 of the column 426 is preferably immovably affixed to the float 412 by suitable conventional braces or the like (not shown) where it passes through the center of the float 412. An aeration outlet 434 is immovably affixed to the lower end 432 of the air delivery column 426, and thus to the remaining structure of the aerator 410. The aeration outlet 434 comprises a relatively flat or thin circular central plenum 436 having a plurality of radially disposed and perforated aeration tubes or nozzles 438 extending therefrom. Each of the tubes or nozzles 438 may comprise a single tube or two concentric tubes, as described further above for the embodiment of FIG. 3. A circular brace 440 is disposed concentrically about the aeration or diffuser tubes 438 and spaced outwardly from the plenum 436, tying the tubes 438 together for greater security.

In FIG. 4, the position of the float 412, air delivery column 426, and aeration outlet 434 are shown with the float positioned near the upper ends of the vertical guides 418 in solid lines, as would be the case with a relatively high water level. If the water level decreases, the float 412 and its attached air delivery column 426 and aeration outlet 434 will descend with the water level, thus lowering the float, column, and aerator outlet, as shown in broken lines in FIG. 4. Since the aeration outlet 434 is immovably affixed to the lower end 432 of the air delivery column 426 and the air delivery column 426 is immovably affixed to the float 412, it will be seen that the aeration tubes 438 remain at a constant fixed depth below the float 412. Thus, as the float 412 rides upon the surface of the water (assuming adequate water depth so that the aeration outlet 434 is not resting upon the anchor base 420*b*), the aeration tubes 438 also remain at a constant fixed depth below the surface of the water. Since this depth is fixed, the water pressure or head at the depth of the aeration tubes is also fixed, thus requiring a constant air pressure from the air supply of either FIG. 1 or FIG. 2. No adjustment of the air pressure is required for the aerator 410, once the pressure has been set.

It is to be understood that the present invention is not limited to the embodiments described above, but encompasses any and all embodiments within the scope of the following claims.

I claim:

1. A buoyant aerator array with remote air supply, the aerator array being adapted for buoyant placement upon the surface of a body of water, the body of water having a floor and an adjacent land mass, the buoyant aerator array comprising:

a plurality of aerators, each of the aerators having a float, an aeration outlet immovably affixed to the float, and a restraining system precluding drift of the aerator;

wherein the aeration outlet comprises a plenum, a plurality of aeration tubes extending radially from the plenum, and a circular brace disposed concentrically about the aeration tubes and the plenum, the brace being separated outwardly from the plenum;

wherein the restraining system being secured to the floor of the body of water;

a single air supply disposed upon the land mass remote from the aerators, the air supply having a compressor, a power source selectively driving the compressor, and an air tank, the single air supply being disposed above the surface of the water and clear of the water; and a plurality of air delivery lines extending above the surface of the water, each of the aerators having a corresponding one of the air delivery lines extending from the air supply to the aerator.

2. The buoyant aerator array according to claim 1, further comprising at least one support column supporting each said air delivery line, the at least one support column being anchored and immovably affixed.

3. The buoyant aerator array according to claim 1, wherein:

the float of at least one of said aerators is toroidal, the aerator further comprising a central air delivery column extending vertically through the float and affixed thereto, the column having a lower end, the aeration outlet extending from the lower end of the column; and the restraining system comprises a plurality of flexible cables extending from the float of said at least one of said aerators, each of the cables having a distal end adapted for being immovably affixed to the floor of the body of water.

4. The buoyant aerator array according to claim 1, wherein:

the float of at least one of said aerators is toroidal, the aerator further comprising a central air delivery column extending vertically through the float and affixed thereto, the column having a lower end, the aeration outlet extending from the lower end of the column; and the restraining system comprises a plurality of vertical guides, the float being slidably disposed upon the guides, each of the guides having a lower end adapted for being anchored to the floor of the body of water.

5. A buoyant aerator array with remote air supply, the aerator array being adapted for buoyant placement upon the surface of a body of water, the body of water having a floor and being adjacent to a land mass, the buoyant aerator array comprising:

a plurality of aerators, each of the aerators having a float, an aeration outlet immovably affixed to the float, and a restraining system precluding drift of the aerator; a floating vessel remotely disposed from the aerators;

wherein the aeration outlet comprises a plenum, a plurality of aeration tubes extending radially from the plenum, and a circular brace disposed concentrically about the aeration tubes and the plenum, the brace being separated outwardly from the plenum;

a single air supply disposed upon the floating vessel, the air supply having a compressor, a power source selectively driving the compressor, and an air tank, the single air supply being disposed above the surface of the water and clear of the water; and a plurality of air delivery lines extending above the surface of the water, each of the aerators having a corresponding one of the air delivery lines extending from the air supply to the aerator.

6. The buoyant aerator array according to claim 5, further comprising at least one support column supporting each said air delivery line, the at least one support column being anchored and immovably affixed.

7. The buoyant aerator array according to claim 5, wherein:

the float of at least one of said aerators is toroidal, the aerator further comprising a central air delivery column extending vertically through the float and affixed thereto, the column having a lower end, the aeration outlet extending from the lower end of the column; and the restraining system comprises a plurality of flexible cables extending from the float of said at least one of said aerators, each of the cables having a distal end adapted for being immovably affixed to the floor of the body of water.

8. The buoyant aerator array according to claim 5, wherein:

the float of at least one of said aerators is toroidal, the aerator further comprising a central air delivery column extending vertically through the float and affixed thereto, the column having a lower end, the aeration outlet extending from the lower end of the column; and the restraining system comprises a plurality of vertical guides, the float being slidably disposed upon the guides, each of the guides having a lower end adapted for being anchored to the floor of the body of water.

9. A buoyant aerator array with remote air supply, the aerator array being adapted for buoyant placement upon the surface of a body of water, the body of water having a floor and being adjacent to a land mass, the buoyant aerator array comprising:

a plurality of aerators, each of the aerators having a float, an aeration outlet immovably affixed to the float, and a restraining system precluding drift of the aerator;

wherein the aeration outlet comprises a plenum, a plurality of aeration tubes extending radially from the plenum, and a circular brace disposed concentrically about the aeration tubes and the plenum, the brace being separated outwardly from the plenum;

wherein the restraining system securing the aerator to the floor of the body of water;

a single air supply disposed remotely from the aerators, the air supply having a compressor, a power source selectively driving the compressor, and an air tank, the single air supply being disposed above the surface of the water and clear of the water;

a plurality of air delivery lines extending above the surface of the water, each of the aerators having a corresponding one of the air delivery lines extending from the air supply to the aerator; and at least one support column supporting each of the air delivery lines, the at least one support column being anchored and immovably affixed.

10. The buoyant aerator array according to claim 9, wherein the single air supply is disposed upon the land mass.

11. The buoyant aerator array according to claim 9, further comprising a floating vessel remotely disposed from the aerators, the single air supply being disposed upon the floating vessel.

12. The buoyant aerator array according to claim 9, wherein:

the float of at least one of said aerators is toroidal, the aerator further comprising a central air delivery column extending vertically through the float and affixed thereto, the column having a lower end, the aeration outlet extending from the lower end of the column; and the restraining system comprises a plurality of flexible cables extending from the float of said at least one of said aerators, each of the cables having a distal end adapted for being immovably affixed to the floor of the body of water.

13. The buoyant aerator array with remote air supply according to claim 9, wherein:

the float of at least one of said aerators is toroidal, the aerator further comprising a central air delivery column extending vertically through the float and affixed thereto, the column having a lower end, the aeration outlet extending from the lower end of the column; and the restraining system comprises a plurality of vertical guides, the float being slidably disposed upon the guides, each of the guides having a lower end adapted for being anchored to the floor of the body of water.

* * * * *